US006053366A

United States Patent [19]

Legué

[11] Patent Number: 6,053,366

[45] Date of Patent: Apr. 25, 2000

[54] CLOSABLE POURING CAP

[75] Inventor: Gerardus Legué , Amsterdam, Netherlands

[73] Assignee: On-Top Products B.V., Zwanenburg, Netherlands

[21] Appl. No.: 09/194,463

[22] PCT Filed: May 20, 1997

[86] PCT No.: PCT/NL97/00277

§ 371 Date: Dec. 14, 1998

§ 102(e) Date: Dec. 14, 1998

[87] PCT Pub. No.: WO97/44247

PCT Pub. Date: Nov. 27, 1997

[51] Int. Cl.[7] ..... B67D 1/08; B65D 83/00; B65B 55/00

[52] U.S. Cl. ..... 222/152; 222/400.8; 222/544; 426/397; 426/404

[58] Field of Search ..... 222/152, 400.7, 222/400.8, 544; 426/394, 397, 404

[56] References Cited

U.S. PATENT DOCUMENTS 4,392,578 7/1983 Fipp et al. ..... 222/401
4,473,174 9/1984 Heuser ..... 222/152

*Primary Examiner*—Kevin Shaver
*Assistant Examiner*—Keats Quinalty
*Attorney, Agent, or Firm*—Darby & Darby

[57] ABSTRACT

A closable pouring cap for a beverage container comprising a housing, a plunger movable in the housing and a pouring opening provided in the housing, while at its bottom side, which is placed on the container. The housing is provided with a fastener to attach the cap to the container and a duct is provided which extends from the bottom side of the housing to the pouring opening and which can be sealed by the plunger. The fastener comprises a seal made of elastic material through which the duct passes and the cap is provided with a pump connected to the duct for the withdrawal of gas present in the duct.

10 Claims, 1 Drawing Sheet

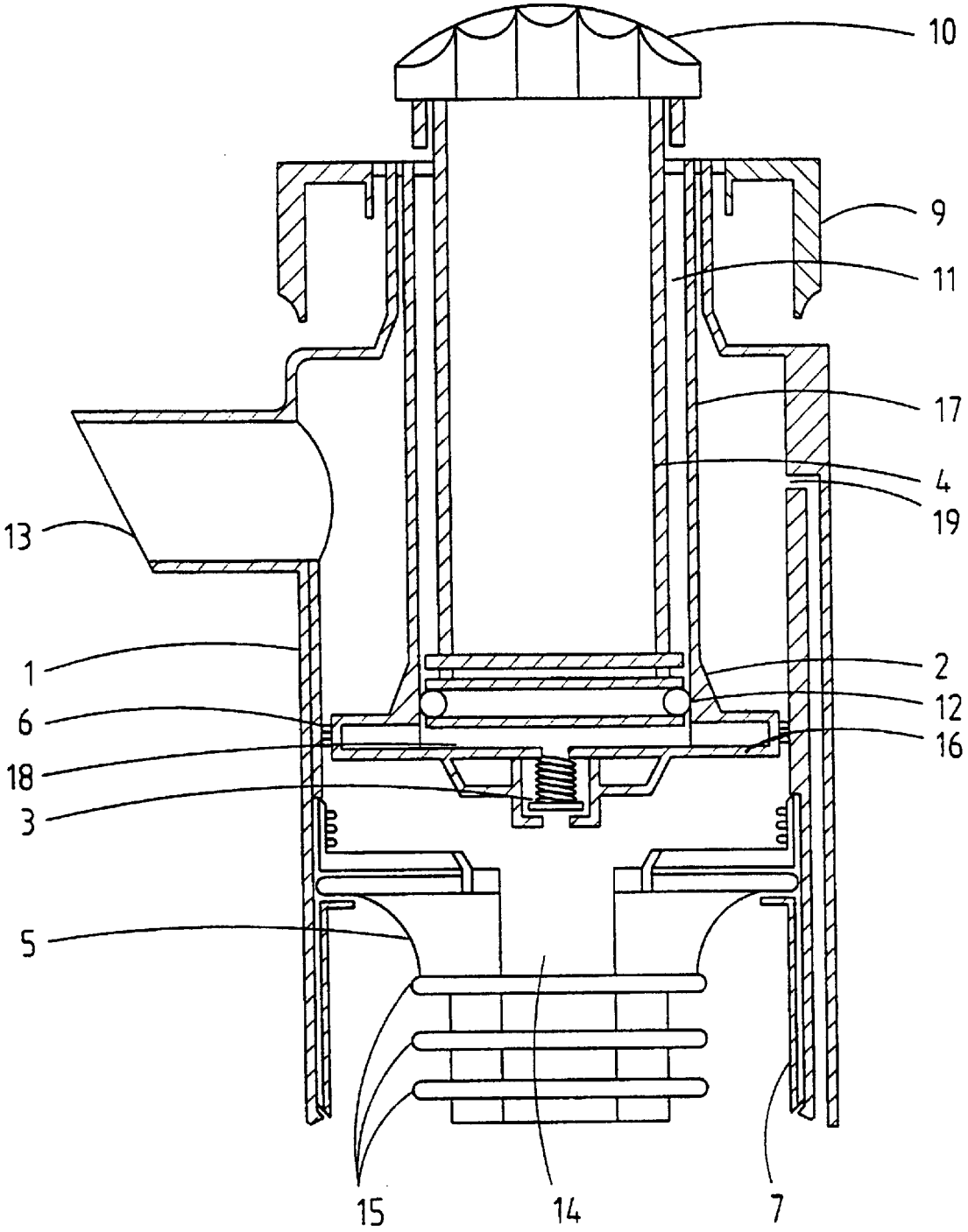
10
9
11
17
4
19
13
1
2
12
6
16
18
3
5
15
14
7

CLOSABLE POURING CAP

The invention relates to a closable pouring cap for a container for drink comprising a housing, a plunger movable in the housing and a pouring opening provided in the housing, while at its bottom side, which is intended for placing on the container, the housing is provided with means for fastening onto the container and a duct is provided which extends from the bottom side of the housing to the pouring opening and which can be sealed by means of the plunger.

Such a pouring cap is known from the European patent application EP-A 0 692 432. Said known pouring cap is in particular suitable for soft drink bottles. However, such a cap is less suitable for containers of liquids whose quality deteriorates after the permanent seal necessary for transport and storage has been removed. This is especially the case with wine bottles, the content of which, after removal of the cork, comes into contact with the air as a consequence of which elements responsible for the flavour of the wine oxidize, and the wine's quality depreciates. It is known that after the wine bottle has been opened and part of the wine consumed, the deterioration in quality can be inhibited by storing the remainder such that the influence of oxygen is prevented as much as possible. It is now the object of the invention to embody the closable cap according to the preamble such that it is suitable for containers in which perishable drink is stored.

To this end the closable cap according to the invention is characterized in that the means for fastening onto the container comprise a seal made of elastic material through which the duct passes and that a pump is provided connected to the duct for the withdrawal of gas present in the duct.

An advantage of the pouring cap according to the invention is that immediately after opening, said pouring cap may be placed on the opening of the container respectively the wine bottle, and can be used as required both as pouring means and as sealing means for the container until said container is empty and the cap may be removed to be placed on a next container of perishable drink.

The problems with the known means for the preservation of wine stored in a bottle, such as the bung known from the Dutch patent application 8600111 is, that in order to be able to pour the drink, the bung has to first be removed and then replaced to seal the container. For the preservation of drink in the container a separate pump has to be applied for the withdrawal of air remaining in the container, which pump has to be shaped conform with the bung on the container. This requires various actions with the chance that the bung has been mislaid just when it should be replaced on the bottle. The pump may also have been mislaid. The user then has the choice to either leave the wine to spoil or, in order to make good use of the remainder, to consume it. This problem will certainly not arise with the pouring cap according to the invention. At any given moment after drawing a particular amount of liquid from the container, the pump of the pouring cap can be activated to withdraw gas in order to preserve the perishable liquid.

To promote its effectiveness, the pouring cap according to the invention is shaped to the opening of the container which the cap is intended to seal, and that in longitudinal direction the seal comprises one or more flexible collars placed concentrically in relation to the duct.

It is desirable that the plunger comprises an end plate which fits tightly in the housing, so that when the plunger is in the closed position, the duct is provided with a gas- and liquid-tight seal and a stem coupled to the end plate, which stem extends to outside the housing and is provided with a control knob. This facilitates the use of the pouring cap. It is preferable that the plunger can be fixed, when it is in the position in which it closes off the duct. This achieves a true seal and avoids that with careless handling an unintentional gas load is put on the liquid in the container.

A simple manner for fixing the plunger in the closing position may, according to the invention, be achieved by providing the end plate of the plunger at least over a portion of its circumference, and the housing at least over a portion of its inner wall, with thread suitable for interacting to fix the plunger in the closed position.

In a particular aspect of the invention the pump of the pouring cap is formed such that the stem of the plunger is hollow, the stem comprises a piston which is movable in the longitudinal direction of the stem, and the end plate of the plunger is provided with a non-return valve. It is clear that, especially when the plunger is fixed in its closed position, the pump may be operated by moving the piston up and down in the fixed stem of the plunger without any risk of displacing the plunger from the closing position.

The simplest manner to realize this is by coupling to the piston a rod extending to outside the housing through the control knob of the plunger, on which rod a piston control knob is provided.

The inner wall of the plunger's stem and the rod of the piston thus define a gas discharge duct allowing the removal of gas withdrawn from the duct. Discharge into the atmosphere takes place via this gas discharge duct.

Proper working of the pump is preferably obtained by providing the piston with an O-ring sealing against the inner wall of the plunger, which O-ring, when pressure above a predetermined value is exerted on the piston, will at least over a portion of its circumference deviate from said inner wall.

Pouring by means of the pouring cap according to the invention is improved through the fact that the housing is provided with a ventiduct which, by means of the plunger, can be sealed simultaneously with the pouring opening. A preferred embodiment of said ventiduct is described in the Dutch patent application 1002577 by the same inventor as the present patent application, which through reference is herewith considered to be inserted.

The invention will now be further elucidated with reference to the drawing of a non-limiting example of an embodiment.

The drawing comprises one FIGURE showing a side view of the closable pouring cap according to the invention in cross-section.

The pouring cap comprises a housing 1, and a plunger 2 movable in the housing 1 and a pouring opening 13 provided in the housing 1, and a seal 5 made of elastic material, preferably rubber, at the side of the housing 1 that is to be placed on a sealable container. The housing 1 comprises a duct 14, while in the drawing the plunger 2 is shown in the position whereby the connection from the duct 14 to the pouring opening 13 is sealed. As is shown clearly in the FIGURE, the seal 5 is shaped to the opening of the container to be sealed, in this case a bottle neck. To this end the seal 5 is provided with one or more flexible, in relation to the duct 14 concentrically positioned collars 15 providing a gas-tight fit of the pouring cap on the opening of the container. The plunger 2 comprises an end plate 16 which, when the plunger 2 is in the closed position, provides a gas- and liquid-tight seal to the duct 14. The plunger 2 also possesses a stem 17 linked to the end plate 16 extending to outside the housing 1 where it is provided with a control knob 9. The pouring cap is preferably embodied such that the plunger 1 can be fixed, when it is in the position in which it seals the duct. To this end the endplate 16 of the plunger 2 may, at least over a portion of its circumference, and the housing 1 may, at least over a portion of its inner wall, be provided with thread suitable for interaction to fix the plunger 2 in the closed position. This is not shown in the Figure. However, the FIGURE does show that the circumference of the endplate 16 and the inner wall of the housing 1 are provided with rubber rings 6 which together, in the end position of the end plate 16 near the seal 5, provide the gas- and liquid-tight seal of the duct 14. To form the pump of the pouring cap according to the invention the stem 17 of the plunger 2 is hollow and the stem 17 comprises a piston 12 which is movable in the longitudinal direction of the stem 17, and the end plate 16 of the plunger 2 is provided with a non-return valve 3. With the piston 12 a rod 4 is coupled which extends to outside the housing 1 through the control knob 9 of the plunger 2. On this rod 4 a piston control knob 10 is provided. The inner wall of the stem 17 of the plunger 2 and the rod 4 of the piston 12 thus define a gas discharge duct 11. The piston 12 is provided with an O-ring 12 to seal against the inner wall of the plunger which O-ring 12, when pressure above a predetermined value is exerted on the piston 12, will at least over a portion of its circumference deviate from said inner wall of the stem 17. This allows compressed air in chamber 18, which is defined by the end plate 16, the inner wall of the stem 17 and the piston 12, to escape into the atmosphere via the gas discharge duct 11. The housing is also provided with a ventiduct 19 which, by means of the plunger 2, can be sealed simultaneously with the pouring opening 13.

The pouring cap may be used as follows. After placing the part of the pouring cap where the seal 5 is located on the bottle neck, the plunger 2 is placed in the highest position by means of the control knob 9; liquid is now able to flow freely via the duct 14 to the pouring opening 13 so that it may be poured from the bottle. Controlled pouring is ensured through de-aeration via ventiduct 19 provided in the wall opposite the pouring opening 13. If the remainder of the liquid is to be stored in the bottle, the plunger 2 can be pushed completely into the housing 1 by means of the control a knob whereby said plunger will eventually reach the closed position and the flexible rings 6 on the end plate 16 and the inner wall of the housing 1 ensure that the duct 14 is sealed completely gas- and liquid-tight.

In a particular embodiment the pouring cap may be embodied such that the plunger 2 is rotatable and that both the end plate 16 and the inner wall of the housing 1 are provided with thread which engage to ensure that the plunger 2 in the closed position is fixed. This is done by turning the control knob 9 while the plunger 2 is in the closed position. In this position the piston control knob 10 provided on top of the control knob 9 can be moved up and down so that gas which is present in the bottle and disperses up to the part of the duct 14 extending through the seal 5, can be withdrawn. As a consequence of pulling the piston control knob 10 up, the piston 12 is simultaneously pulled up thereby enlarging the chamber 18 defined by the endplate 16, the inner wall of the stem 17 of the plunger 2 and the piston. The vacuum thus produced in this chamber 18 causes the non-return valve 3 to open so that gas present in the bottle can fill this chamber 18. As soon as the piston control knob 10 has reached the highest position, the non-return valve 3 closes and by a downward movement of the piston control knob 10 the gas present in the chamber 18 escapes along a portion of the piston ring 12 which deviates from the inner wall of the stem 17 and escapes via the gas discharge duct 11 into the atmosphere. Repeating this movement of the piston control knob 10 a few times brings about the desired under-pressure in the bottle. If later the content of the bottle is required to be poured out,the control knob 9 of the piston 2 is pulled up, causing the pressure between the bottle and the atmosphere to equilibrate so that the liquid can flow out.

I claim:

1. A closable pouring cap for a container for drink comprising a housing (1), a plunger (2) movable in the housing and a pouring opening (13) provided in the housing, while at its bottom side, which is intended for placing on the container, the housing is provided with means for fastening onto the container and a duct is provided which extends from the bottom side of the housing to the pouring opening and which can be sealed by means of the plunger, characterized in that the means for fastening onto the container comprise a seal (5) made of elastic material through which the duct (14) passes and that a pump (17, 3, 12, 4, 10) is provided connected to the duct for the withdrawal of gas present in the duct.

2. A pouring cap according to claim 1, characterized in that the seal (5) is shaped to the opening of the container which the cap is intended to seal, and that in longitudinal direction the seal (5) comprises one or more flexible collars (15) placed concentrically in relation to the duct (14).

3. A pouring cap according to claim 1, characterized in that the plunger (2) can be fixed, when it is in the position in which it closes off the duct (14).

4. A pouring cap according to claim 1, characterized in that the housing (1) is provided with a ventiduct (19) which, by means of the plunger (2), can be sealed simultaneously with the pouring opening (13).

5. A pouring cap according to claim 1, characterized in that the plunger (2) comprises an end plate (16) which fits tightly in the housing (1), so that when the plunger (2) is in the closed position, the duct (14) is provided with a gas- and liquid-tight seal and a stem (17) coupled to the end plate (16), which stem (17) extends to outside the housing (1) and is provided with a control knob (9).

6. A pouring cap according to claim 5, characterized in that the end plate (16) of the plunger (2) at least over a portion of its circumference, and the housing (1) at least over a portion of its inner wall are provided with thread suitable for interacting to fix the plunger (2) in the closed position.

7. A pouring cap according to claim 5, characterized in that the pump is formed such that the stem (17) of the plunger (2) is hollow, the stem (17) comprises a piston (12) which is movable in the longitudinal direction of the stem, and the end plate (16) of the plunger (2) is provided with a non-return valve (3).

8. A pouring cap according to claim 7, characterized in that a rod (4) is coupled to the piston (12), which rod (4) extends to outside the housing (1) through the control knob (9) of the plunger (2) and on which rod (4) a piston control knob (10) is provided.

9. A pouring cap according to claim 7, characterized in that the inner wall of the plunger's (2) stem (17) and the rod (4) of the piston (12) define a gas discharge duct (11).

10. A pouring cap according to claim 7, characterized in that the piston (12) is provided with a piston ring (12) sealing against the inner wall of the stem (17) of the plunger (2), which piston ring (12), when pressure above a predetermined value is exerted on the piston (12), will at least over a portion of its circumference deviate from said inner wall.

* * * * *